US006460712B2

(12) United States Patent
Smith et al.

(10) Patent No.: US 6,460,712 B2
(45) Date of Patent: Oct. 8, 2002

(54) ONE-PIECE TAMPER-EVIDENT CLOSURE SYSTEM WITH A RESEALABLE, HINGED LID

(75) Inventors: Kelly A. Smith, East Troy; Charles E. Roberts, Eagle, both of WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 30 days.

(21) Appl. No.: 09/775,916

(22) Filed: Feb. 2, 2001

(65) Prior Publication Data

US 2002/0104843 A1 Aug. 8, 2002

(51) Int. Cl.[7] ..... B65D 47/08; B65D 47/10

(52) U.S. Cl. ..... 215/235; 215/237; 215/253; 215/256; 220/837; 220/276; 222/541.5

(58) Field of Search ..... 215/235, 237, 215/250, 253, 254, 256; 220/254.3, 259.1, 837, 839, 847, 270, 276; 222/556, 541.5, 541.6, 541.9

(56) References Cited

U.S. PATENT DOCUMENTS

| | | | | | |
|---|---|---|---|---|---|
| 2,990,077 | A | * | 6/1961 | Van Baarn | 215/256 |
| 3,272,368 | A | | 9/1966 | Baarn | |
| 3,458,080 | A | | 7/1969 | Laurizio | |
| 4,043,475 | A | * | 8/1977 | Wheeler | 215/256 |
| 4,385,708 | A | | 5/1983 | Curry | |
| 4,394,918 | A | * | 7/1983 | Grussen | 215/253 |
| 4,438,864 | A | | 3/1984 | Helms | |
| 4,467,931 | A | | 8/1984 | Gach | |
| 4,646,926 | A | | 3/1987 | Agbay et al. | |
| 4,759,455 | A | | 7/1988 | Wilson | |
| 4,787,525 | A | | 11/1988 | Joyce | |
| 4,807,769 | A | | 2/1989 | Gach | |
| 4,919,286 | A | * | 4/1990 | Agbay, Sr. | 215/253 |
| 4,934,556 | A | | 6/1990 | Kleissendorf | |
| 4,941,580 | A | | 7/1990 | Julian | |
| 4,969,574 | A | | 11/1990 | Shastal | |
| 4,984,716 | A | * | 1/1991 | Beck | 215/256 |
| 5,007,555 | A | | 4/1991 | Beck | |
| 5,040,691 | A | | 8/1991 | Hayes et al. | |
| 5,147,054 | A | * | 9/1992 | Pehr | 215/237 |
| 5,249,695 | A | | 10/1993 | Luch et al. | |
| 5,271,519 | A | | 12/1993 | Adams et al. | |
| 5,273,177 | A | | 12/1993 | Campbell | |
| 5,303,837 | A | | 4/1994 | Adams et al. | |
| 5,335,802 | A | * | 8/1994 | Brach et al. | 215/235 |
| 5,348,183 | A | | 9/1994 | Luch et al. | |
| 5,397,013 | A | | 3/1995 | Adams et al. | |
| 5,464,112 | A | | 11/1995 | Guillot | |
| 5,577,643 | A | | 11/1996 | Stolz | |
| 5,605,240 | A | * | 2/1997 | Guglielmini | 215/235 |
| 5,678,719 | A | | 10/1997 | Adams et al. | |
| 5,779,110 | A | * | 7/1998 | Brown et al. | 215/237 |
| 5,855,288 | A | | 1/1999 | Dallas, Jr. | |
| 5,860,543 | A | | 1/1999 | Decelles | |
| 5,875,942 | A | * | 3/1999 | Ohmi et al. | 215/237 |
| 5,915,574 | A | | 6/1999 | Adams et al. | |

* cited by examiner

*Primary Examiner*—Nathan J. Newhouse
(74) *Attorney, Agent, or Firm*—Wood, Phillips, Katz, Clark & Mortimer

(57) ABSTRACT

A closure structure is provided for a container that has an opening to the container interior. The closure structure includes a closure base for extending around the container opening. A lid is provided on the closure base and is connected to the base by a hinge web. The hinge web has a first end connected to the closure base, a second end connected to the lid, and two sides which each extends between the first and second ends. A frangible, reduced-thickness section of material initially connects the lid to the closure base and initially connects both of the hinge web sides to the closure base or to the lid for initially holding the lid sealed closed at a tamper-evident, first closed position and for subsequently accommodating movement of the lid relative to the first closed position to break the frangible connection and become selectively located at one of the following positions: (1) a second closed position inwardly of the first closed position, and (2) an open position outwardly of both the first closed position and second closed position.

11 Claims, 8 Drawing Sheets

47
48
72
80
17
83
84
42
43
60
66
64
57
55
56
46
41

ONE-PIECE TAMPER-EVIDENT CLOSURE SYSTEM WITH A RESEALABLE, HINGED LID

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to containers and closures. The invention is more particularly related to a sealable closure which is especially suitable for use with a wide-mouth container of product that can be scooped from or poured from the container when the closure lid is opened.

BACKGROUND OF THE INVENTION AND TECHNICAL PROBLEMS POSED BY THE PRIOR ART

Various product packaging designs employ closures with one or more barriers or seals across an opening to the package. Such seals can serve as primary or secondary barriers to contaminant ingress. Such seals may also maintain product freshness. In addition, such seals may provide a tamper-indicating function wherein breaking or removing the seal provides evidence that the package has been opened.

Examples of a closure with an internal tamper-indicating seal are disclosed in U.S. Pat. Nos. 4,948,003 and 4,807,769. These types of closures include a base for mounting the closure to the container. The base includes a pour spout. The pour spout is initially occluded by a sealing disk or member. The periphery of the sealing disk defines a reduced cross-sectional thickness of material which functions as a frangible web connecting the sealing disk to a radially outward region of material. An exterior portion of the sealing disk may include a pull tab which is grasped by a user's fingers for ripping the sealing disk out of the pour spout. The closure also includes a hinged lid with an internal collar to telescopically receive the pour spout in sealing engagement when the lid is closed so as to provide a liquid-tight and air-tight system after the sealing disk has been removed.

While closures of the above-discussed type may function generally satisfactorily in applications for which they are intended, it would desirable according to discoveries relating to the present invention to provide an improved closure with enhanced features.

For example, some containers, such as jars for peanut butter and other such paste-like products, typically have a relatively wide mouth. It would be desirable to provide an improved closure which could extend over the wide mouth of such a container and which would have a lid that could be opened to permit access to the container interior and subsequently closed.

Preferably, such an improved closure should accommodate insertion of a kitchen implement such as a knife, spoon, or spatula after the lid is opened without requiring removal of the closure from the container.

Further, it would be desirable if such an improved closure could include means for retaining the lid with the closure when the lid is open. Further, it would be advantageous if such an improved closure could include means for providing tamper-indication that would furnish evidence that the lid has been opened or at least that could provide evidence of tampering with the lid. It would be desirable to provide such tamper-indication means that is consumer friendly with respect to its operations and that does not create loose waste pieces requiring disposal.

Some types of containers, especially containers designed for food products or pharmaceutical products, include a thin, flat paper or film liner secured to the top of the container across the mouth of the container. The liner must be broken and/or removed in order to permit the container contents to be accessed. Such a liner has a tamper-indicating function. Such a liner also serves to prevent contaminant ingress and maintain product freshness. It would be desirable to provide an improved closure which could accommodate the use of such a liner initially on the container and which could, after removal of the liner, provide a re-sealing function. Preferably, such an improved closure should accommodate the use of existing liner technology, including separate induction or pressure sensitive innerseals.

Also, it would be desirable if such an improved closure could be provided with a design that would accommodate efficient, high quality, large volume manufacturing techniques with a reduced product reject rate. Further, it would be beneficial if the improved closure could be molded in the closed position so as to maximize mold capacity and increase manufacturing efficiency.

Further, such an improved closure should advantageously accommodate its use with a variety of conventional containers having a variety of conventional container finishes, such as conventional threaded or snap-fit attachment configurations. Such an improved closure design should also optionally accommodate the incorporation of the closure as a unitary part of the container.

The present invention provides an improved closure which can accommodate designs having the above-discussed benefits and features.

SUMMARY OF THE INVENTION

According to the present invention, an improved closure structure is provided for an opening to a container interior. The closure structure includes a lid which is easily manipulated by the user to an open position and which can be readily closed to occlude the opening. The closure structure of the present invention is adapted to reseal an inner peripheral surface defined at least partly around the container opening. The closure is also provided with a tamper-indicating, frangible web which is torn when the lid is initially opened.

According to one aspect of the invention, the closure includes a closure base for extending around the container opening, and the closure includes a lid on the closure base. The lid is connected to the base with a hinge web. The hinge web has (1) a first end connected to the closure base, (2) a second end connected to the lid, and (3) two sides which each extends between the first and second ends. A frangible, reduced-thickness section of material also initially connects the lid to the closure base. The frangible, reduced-thickness section of material also initially connects both of the hinge web sides to the closure base or to the closure lid for initially holding the lid sealed closed at a tamper-evident, first closed position. In the preferred embodiment, the frangible, reduced thickness section of material initially connects both of the hinge web sides to the closure base.

The closure structure accommodates subsequent movement of the lid relative to the first closed position so as to break the frangible connection and so that the lid becomes selectively located at one of the following two positions: (1) a second closed position inwardly of the first closed position, or (2) an open position outwardly of both the first closed position and the second closed position. In a preferred form of operation, the lid can be initially pushed down by the user to break the frangible, reduced-thickness section of material. Subsequently, the lid can be lifted upwardly, past the initial, first closed position, to an open position, including to an open position that locates the lid at a substantially 180° orientation relative to the initial, first closed position of the lid. This permits access to the container opening without interference from the lid.

In an alternate form of operation, instead of the user initially pushing down on the lid, the user may pull the lid upwardly to tear the frangible, reduced-thickness section of material that initially connects the lid to the closure base.

The closure is especially suitable for use with large, "wide-mouth" jars or other containers. When the closure is open, a wide range of kitchen implements, such as knives, spoons, spatulas, etc., can be inserted into the opening for removing the contents from the container. In the preferred embodiment, the closure structure is a separate closure that is adapted to be mounted on the container and that defines an access aperture for communicating with the container opening. However, in an alternate form of the closure structure, the closure structure can be formed as a unitary part (i.e., extension) of the container at the container opening.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 14 shows the lid opened a little more than 90° from the first closed position;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure elements or features of this closure structure invention are described in various positions, and terms such as upper, lower, horizontal, etc., are used with reference to these positions. It will be understood, however, that the closure elements may be manufactured and stored in orientations other than the ones described.

Figure 2:
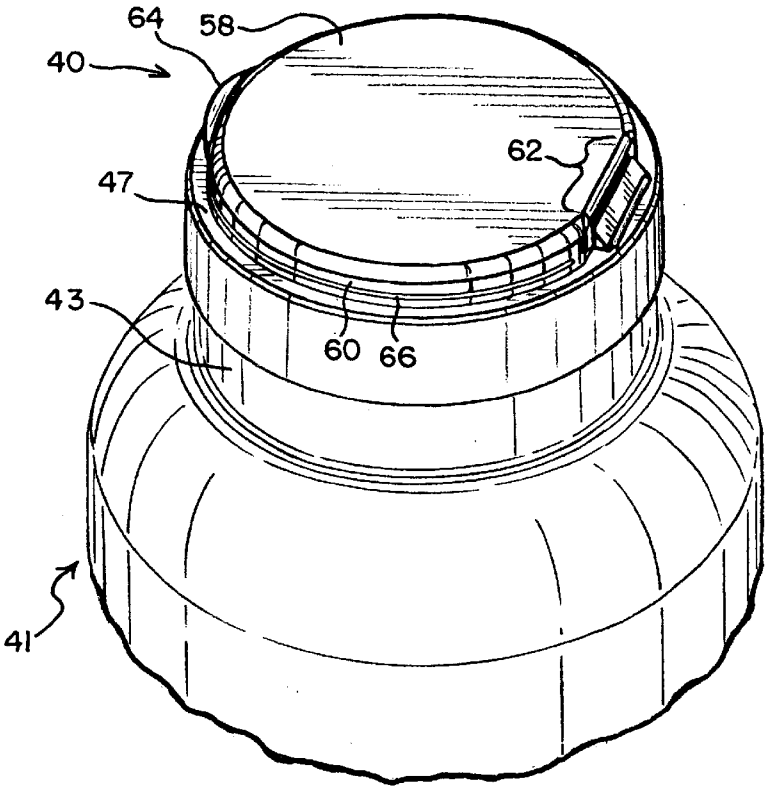
FIG. 2 is a view similar to FIG. 1, but FIG. 2 is a rear, perspective view of the closure.
Figure 1:
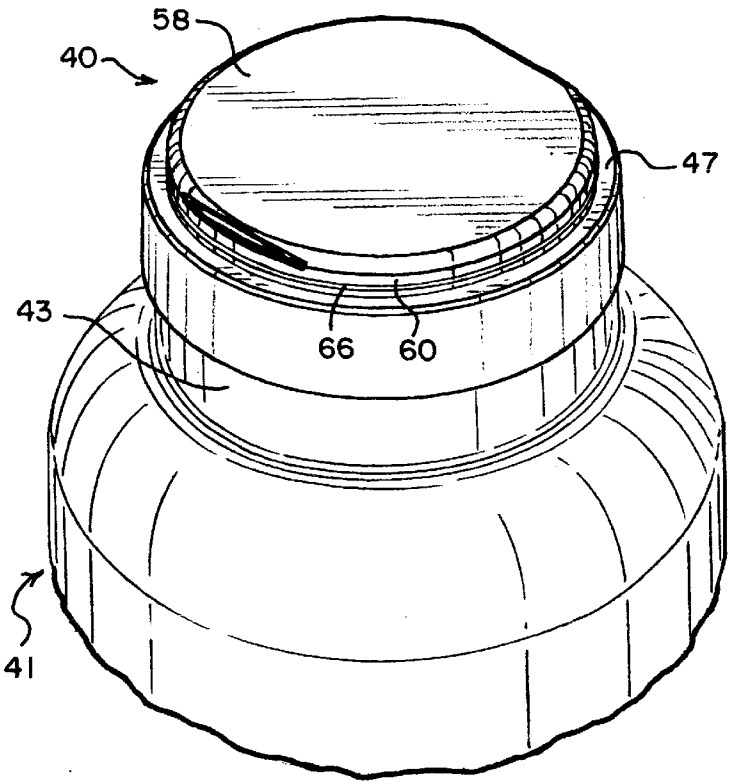
FIG. 1 is a fragmentary, front, perspective view of a preferred embodiment of a closure structure of the present invention in the form of a separate closure shown mounted on a container with the closure lid in a first closed position and with a tamper-evident frangible section or membrane intact.
Figure 8:
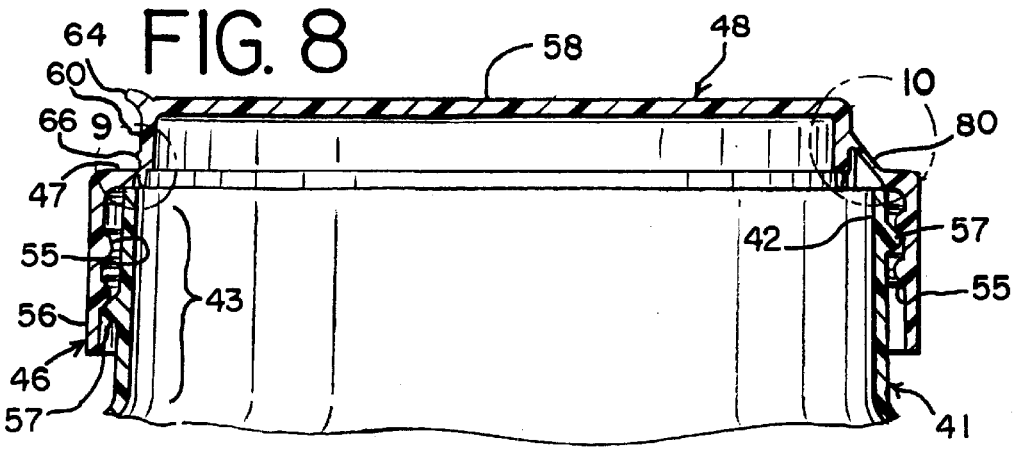
FIG. 8 is a fragmentary, cross-sectional view taken generally along the plane 8—8 in FIG. 6, but FIG. 8 also shows the closure installed on the container.

With reference to the figures, a presently preferred embodiment of a closure structure of the present invention is illustrated in FIGS. 1–17 as a separately formed closure which is represented generally in the figures by reference number 40. As shown in FIGS. 1 and 2, the closure 40 is adapted to be disposed on a container 41 which has a mouth or opening 42 (FIG. 8). The opening 42 is typically defined by a neck 43 (FIGS. 1, 2, and 8) or other suitable structure at the top of the container 41. The neck 43 typically has (but need not have) a circular cross-sectional configuration, and the body of the container 41 may have another cross-sectional configuration, such as an oval cross-sectional shape, for example. The container 41 need not have a separately identifiable neck 43 per se. The container 41 could instead have just a main body portion terminating in an upper end. The container 41 may have a rigid wall or walls. Also, the container 41 may be a squeezable container having a flexible wall or walls.

Figure 3:
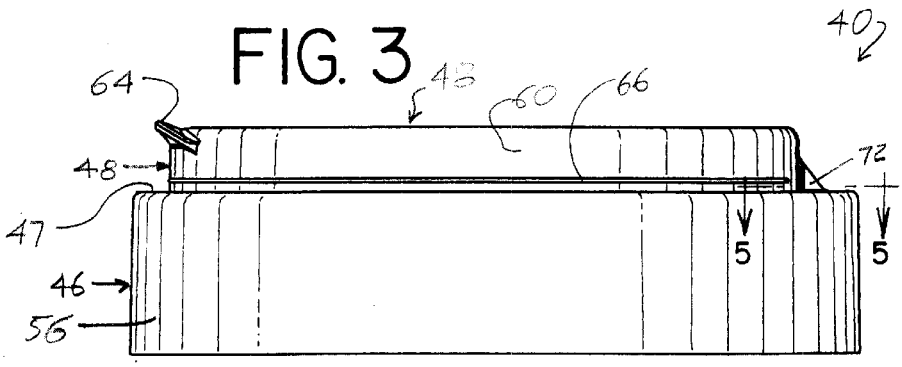
FIG. 3 is a side elevation view of the closure prior to installation on the container and with the lid in the first closed position.

As shown in FIGS. 3 and 8, the closure 40 can be readily injection-molded from thermoplastic materials compatible with the container contents, and the closure 40 includes a base or lower closure portion 46 and a lid 48.

Figures 16, 17:
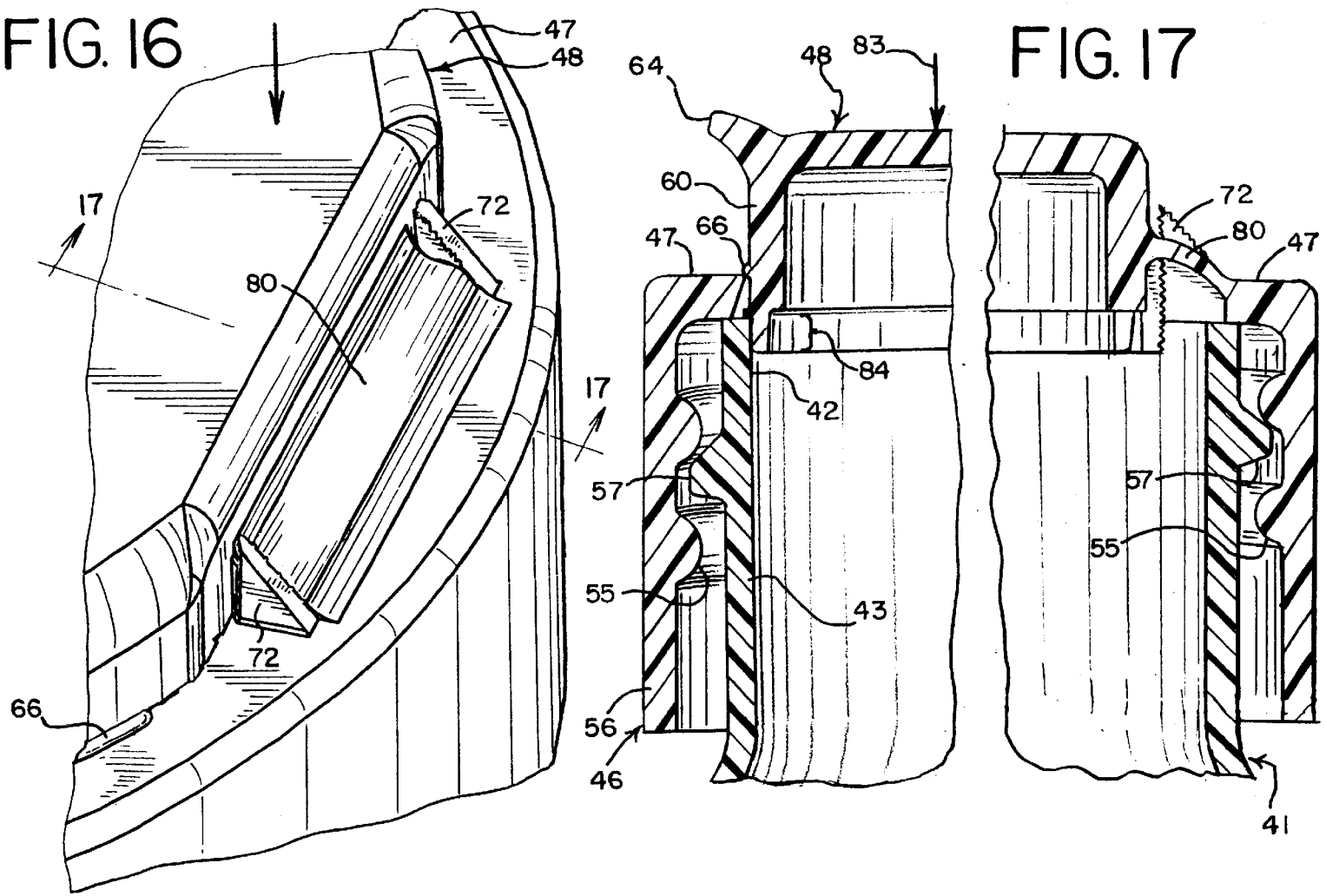
FIG. 16 is a view similar to FIG. 4, but FIG. 16 shows the lid in the second closed position after the tamper-evident section has been broken.
FIG. 17 is an enlarged, fragmentary, cross-sectional view similar to FIG. 8, but FIG. 17 shows the lid in the second closed position corresponding to the position of the lid shown in FIG. 16.

In the first embodiment illustrated in FIGS. 8 and 17, the lower closure portion or base 46 includes a peripheral deck 47 (FIGS. 1, 2, 3, 4, 5, 6, 8, 9, 10, 13, 14, 15, 16, and 17) and includes a downwardly depending annular skirt or wall 56. As shown in FIGS. 8 and 17, the skirt 56 may have suitable connecting means (e.g., a conventional thread 55 (or conventional snap-fit bead which is not illustrated)) for engaging suitable cooperating means (e.g., a thread 57 (or groove which is not shown)) to secure the lower closure portion or base 46 to the container 41. The lower closure portion or base 46 and the container 41 could also be welded together by induction melting or ultrasonic melting. The base 46 defines an access aperture 49 (FIG. 13) for communicating with the container opening.

In the preferred embodiment as shown in FIGS. 1 and 2, the lid 48 includes a horizontal top deck or wall 58 and a depending wall or flange 60 that extends around the lid 48 except where the flange 60 is interrupted by a hinge region 62 (FIG. 2) described in more detail hereinafter.

Figure 4:
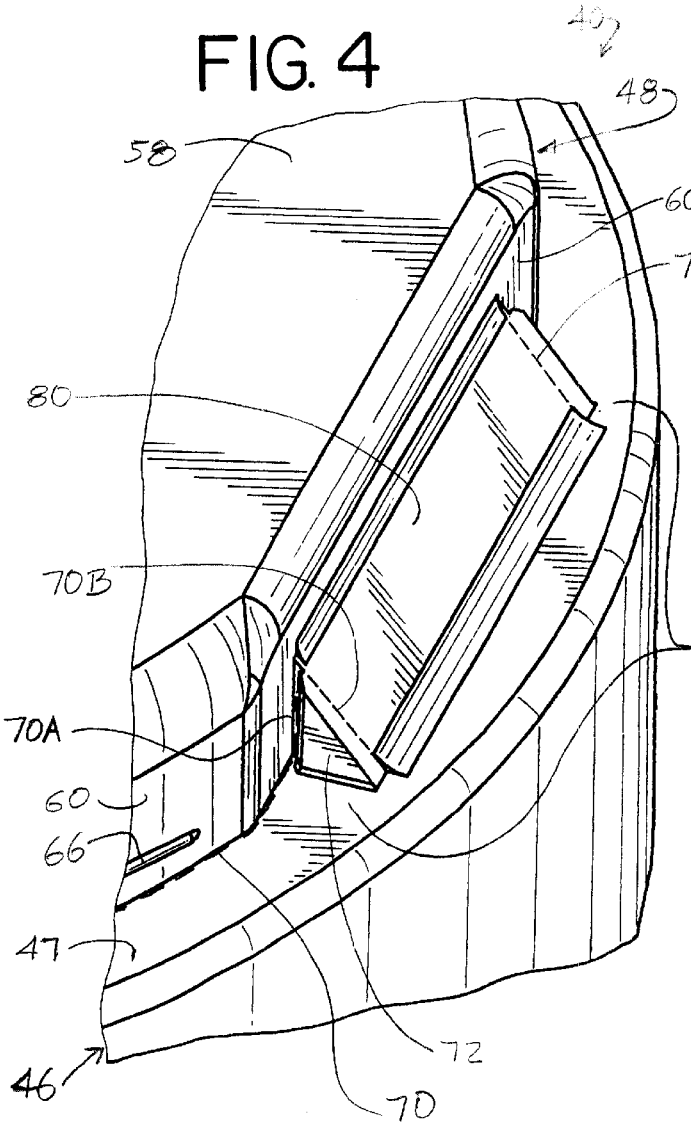
FIG. 4 is a fragmentary, greatly enlarged, perspective view of the hinge region of the closure prior to installation on the container.
Figure 9:
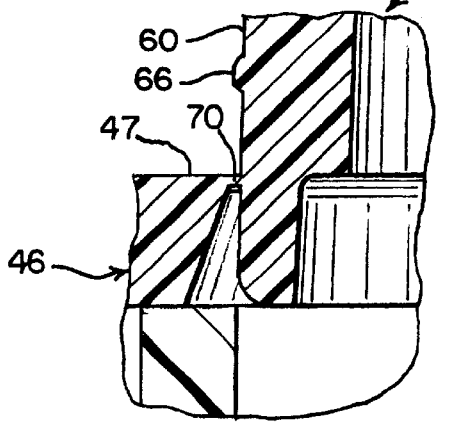
FIG. 9 is a fragmentary, greatly enlarged, cross-sectional view showing the portion of the closure within the circle designated 9 in FIG. 8.
Figure 10:
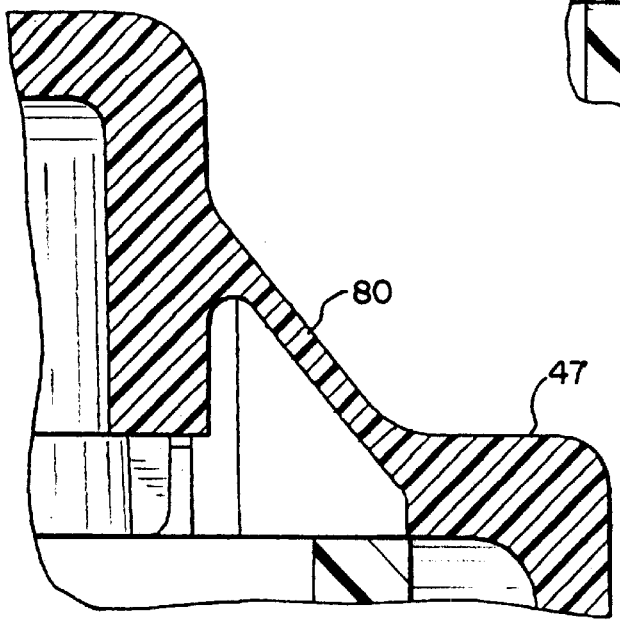
FIG. 10 is a fragmentary, greatly enlarged, cross-sectional view showing the portion of the closure within the circle designated 10 in FIG. 8.
Figure 11:
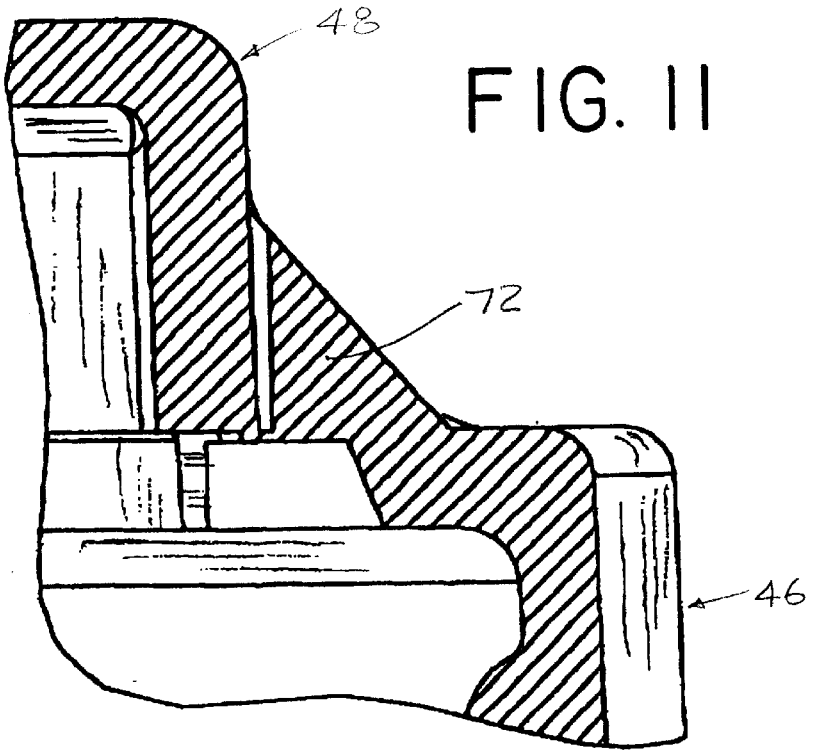
FIG. 11 is a fragmentary, greatly enlarged, cross-sectional view taken generally along the plane 11—11 in FIG. 5.

At the top of the flange 60 at the front of the lid 48, as shown in FIGS. 2, 3, and 8, there is a thumb lift or finger lift projection or tab 64 which can be grasped between the user's finger and thumb or which can be pushed up by the user's thumb in order to lift the lid 48. Around the periphery of the flange 60 is an outwardly projecting bead 66 (FIGS. 3, 4, and 8). As shown in FIGS. 8 and 9, the bead 66 is located on the flange 60 slightly above the deck 47 of the closure base 46 when the lid 48 is in the as-molded, initial, first closed position. Because of the perspective of the view in FIGS. 1 and 2, the bead 66 appears to be adjacent the closure base deck 47, but the bead 66 is actually located sufficiently above the deck 47 (as shown in FIG. 9) to accommodate subsequent movement of the lid flange 60 vertically downwardly a slight amount from the first closed position illustrated in FIG. 9 to the second closed position illustrated in FIGS. 16 and 17 wherein the bead 66 engages the inner peripheral edge of the deck 47.

As shown in FIG. 9, the lid 48 and closure base 46 are initially molded together as a unitary structure, and there is an initial, as-molded connection between the lid 48 and the base 46 which has the form of a frangible, reduced-thickness section of material 70 (FIG. 9) which extends around the periphery of the lid skirt 60 and along each side of the hinge region 62 in a manner described in detail hereinafter. The reduced-thickness section of material 70 can be broken by the user initially pushing downwardly on the lid deck 58 (FIG. 8) or by initially pushing upwardly on the thumb tab 64 (FIG. 8).

Figure 5:
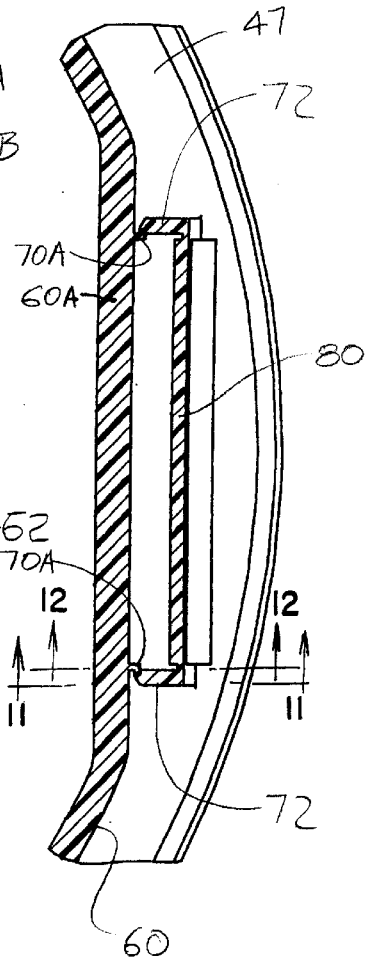
FIG. 5 is a fragmentary, greatly enlarged, cross-sectional view taken generally along the plane 5—5 in FIG. 3.
Figure 6:
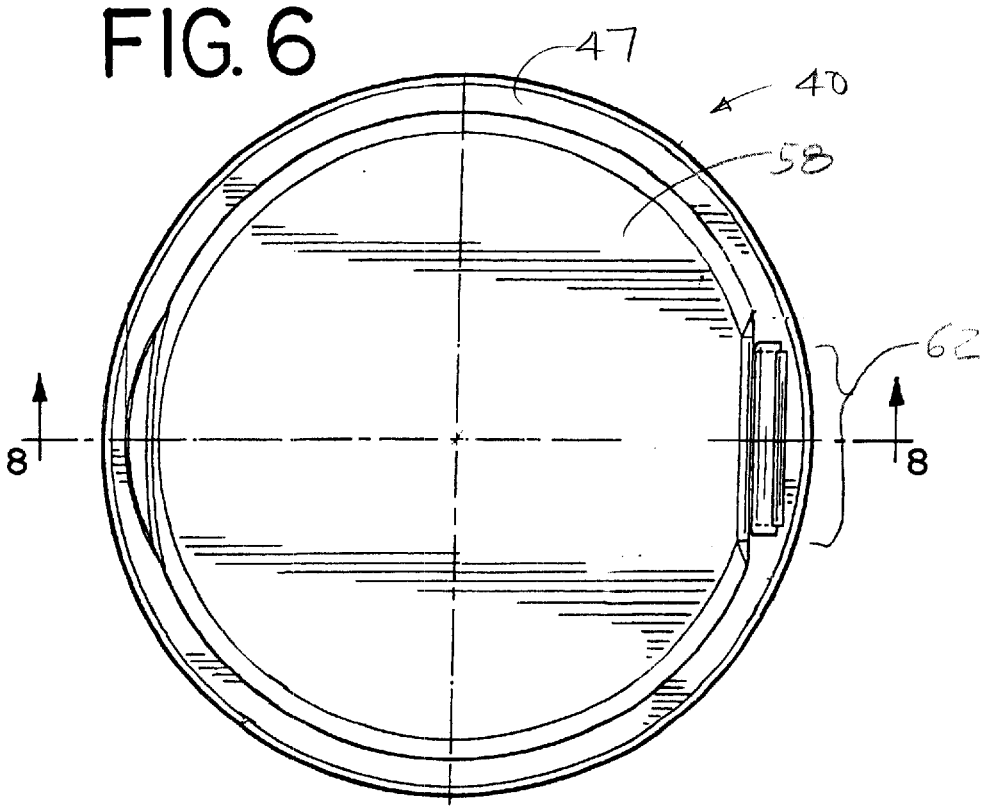
FIG. 6 is a top plan view of the closure shown in FIG. 3.
Figure 7:
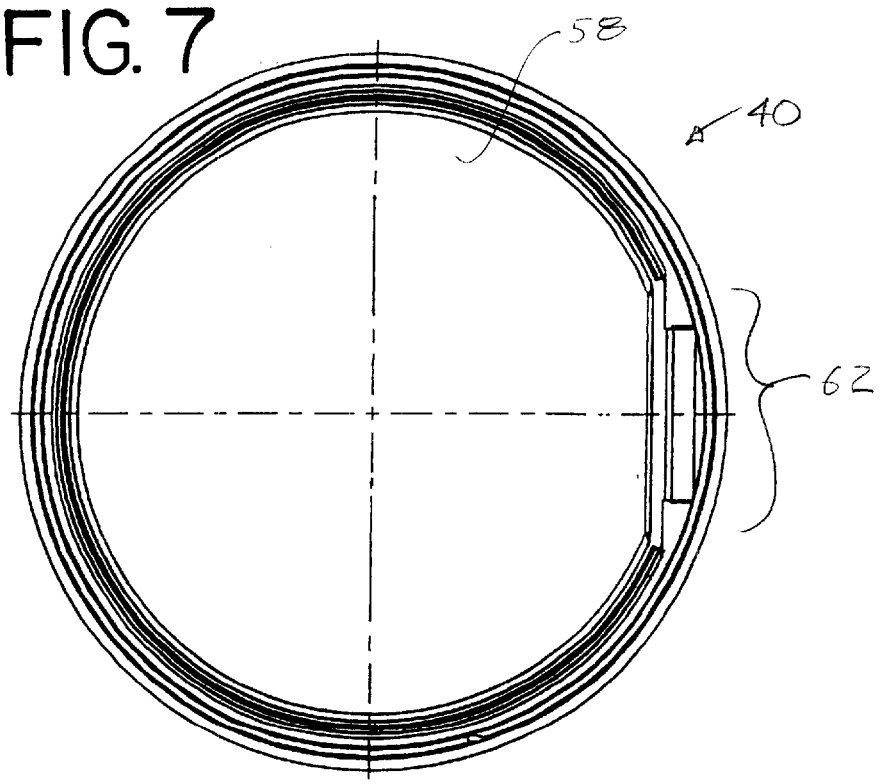
FIG. 7 is a bottom plan view of the closure shown in FIG. 3.

With reference to the hinge region 62 shown in FIG. 4, the lid skirt 60 includes a generally planar, flattened portion 60A. A hinge web 80 extends from the lid rear planar portion 60A to the deck 47 of the closure base 46. In the presently preferred configuration, the hinge web 80 has a generally rectangular, planar shape in the as-molded condition as shown in FIG. 4. The hinge web 80 is initially molded as a unitary structure with, and extending between, a pair of spaced-apart, generally triangular support members 72 (FIGS. 4 and 5). Each support member 72 projects upwardly as a unitary part of the closure base 46.

As shown in FIGS. 4 and 5, the hinge web 80 maybe characterized as having a first end connected to the closure base 46, a second end connected to the lid 48, and two sides or edges which each extends between the first and second ends. Each side of the web 80 extends along the upper, slanted portion of an adjacent support member 72.

The frangible, reduced-thickness section of material 70 that initially joins the lid 48 to the base 46 as shown in FIG. 4 also extends around the rear of the lid 48 and into the hinge region 62 as shown in FIG. 4. For convenience of illustration, the reduced-thickness section of material 70 is shown as a dashed line in FIG. 4. However, it will be appreciated that the reduced-thickness section of material 70 is preferably formed as a continuous thin section of material, such as a membrane, between the closure of base 46 and lid 48 as illustrated in FIG. 9. Alternatively, the reduced-thickness section of material maybe provided either as intermittent, spaced-apart, molded recesses or as recesses that are subsequently slit into, but not completely through, the molded material.

Figure 12:
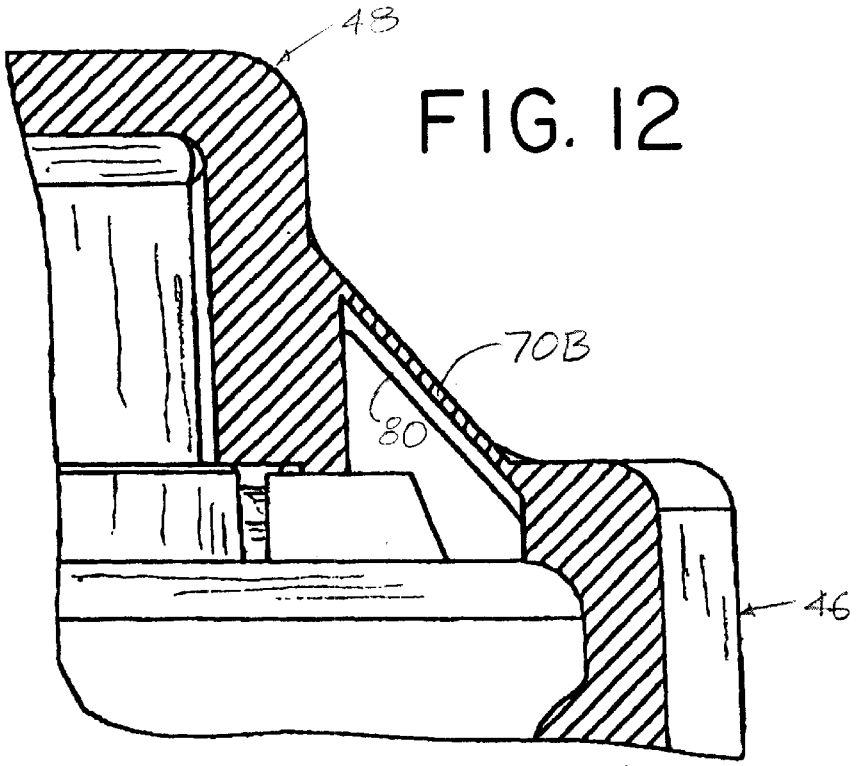
FIG. 12 is a fragmentary, greatly enlarged, cross-sectional view taken generally along the plane 12—12 in FIG. 5.

With reference to FIGS. 4 and 5, the reduced-thickness section of material 70 is seen to extend rearwardly into the hinge region 62 and vertically up the inside edge of each support member 72. In FIG. 5, the vertical extension of the reduced-thickness section of material is designated with the reference and number 70A. With reference to FIGS. 4 and 12, the reduced-thickness section of material extends along and down the underside of the hinge web 80 adjacent each support member 72, and the downwardly extending reduced-thickness section of material is designated in FIGS. 4 and 5 by the reference number 70B. In FIG. 4, the reduced-thickness section of material 70B along the slanted portion of each support member 72 is represented by a dashed line. However, it will be appreciated that in the preferred embodiment of the invention, the downwardly slanting reduced-thickness section of material 70B along each support member 72 is a continuous membrane formed by omitting material from the underside of the hinge web 70 along each side edge so as to form the reduced-thickness section of material. Of course, alternatively, the reduced-thickness section of material could be defined by other means, such as molded recesses or recesses that are slit into, but not completely through, the material after molding, etc.

The closure structure 40 is initially molded as a unitary piece as shown in FIG. 3 wherein the lid 48 is in a first closed position relative to the closure base 46 and wherein the lid 48 and base 46 are connected together around the periphery of the lid 48 and through the hinge region 62 (FIG. 4) by means of the reduced-thickness section of material or membrane 70, 70A and 70B which is formed during the initial molding process or other manufacturing process. The molded closure (as shown in FIG. 3) is then installed on a container 41 (as shown in FIG. 8) which has previously been filled with a product.

In order to initially open the closure, the user can push downwardly on the lid deck 58 (FIG. 8) to rupture the frangible membrane 70, 70A, 70B around the lid 48 and along the sides of the hinge region 62 (FIG. 4). When the lid 48 is initially pushed downwardly far enough (in the direction of the arrow 83 as shown in FIG. 17), the lid bead 66 engages the top, inner edge of the closure base deck 47 to prevent further downward movement. With continued reference to FIG. 17, it will be appreciated that the lid skirt 60 has a bottom portion 84 below the bead 66, and the bottom portion 84 may be characterized as a seal member for engaging at least a portion of the of the inner peripheral surface of the container opening 42.

With reference to FIGS. 16 and 17, the reduced-thickness section of material or membrane 70A and 70B in the hinge region adjacent the support members 72 will rupture and break. The upper end of the hinge web 80 will thus be able to move downwardly to the position shown in FIGS. 16 and 17. In the downward position, the lateral side edges of the hinge web 80 engage the inside, vertical, planar surfaces of the support members 72 so as to prevent access to the container interior through the hinge region.

The position of the lid 48 in FIGS. 16 and 17 may be characterized as a second closed position inwardly of the first closed position (which is the initial as-molded closed condition illustrated in FIG. 8).

The invention accommodates an alternate way of breaking the frangible membrane. In particular, instead of the user pushing down on the lid 48, the user could lift upwardly on the lid thumb tab 64 (FIG. 8) to tear the membrane 70, 70A, and 70B around the lid 48 and along the hinge support members 72.

Figure 13:
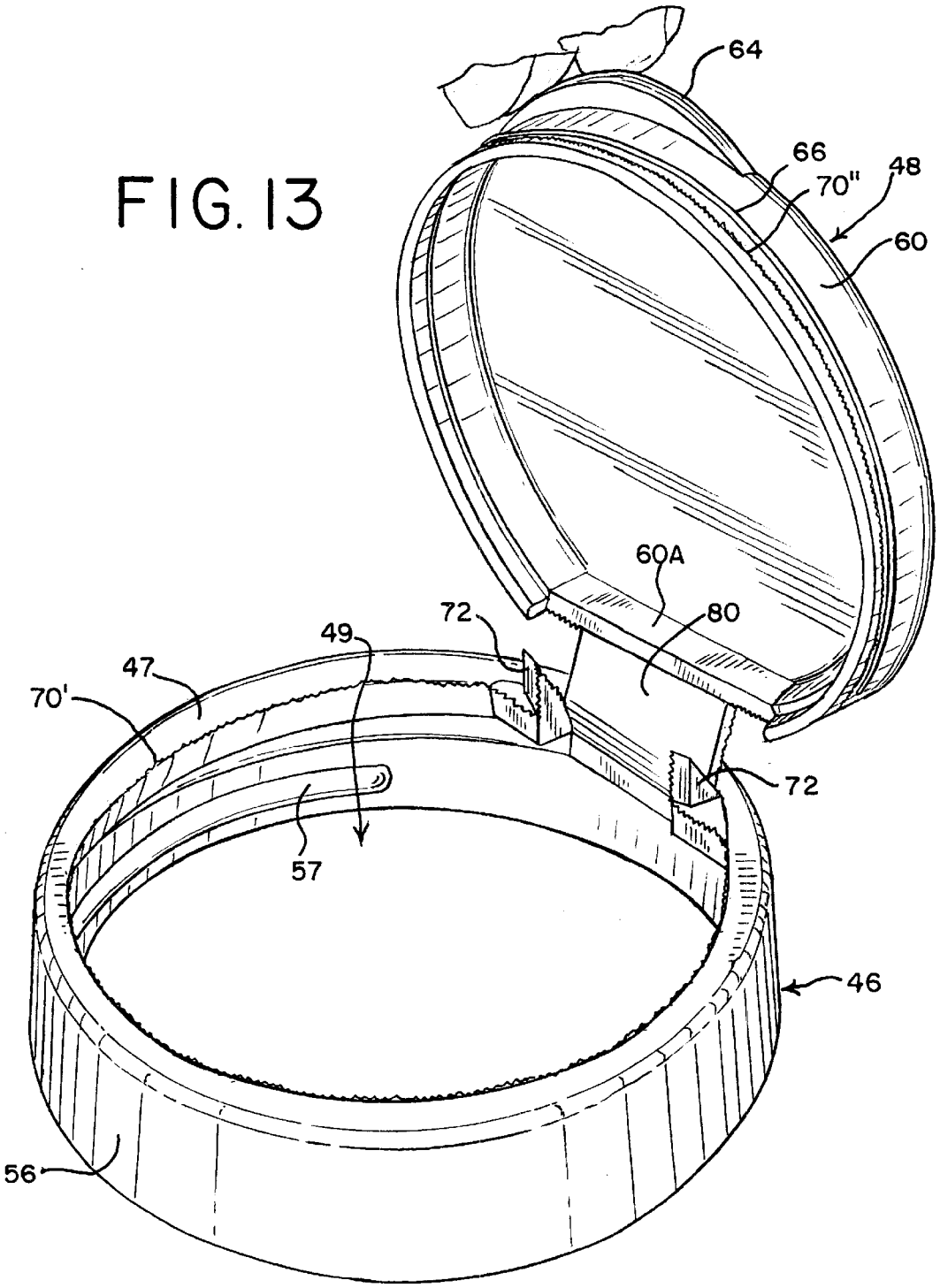
FIG. 13 is a view similar to FIG. 1, but in FIG. 13 the container is omitted for ease of illustration, and the lid is shown lifted to an open position after the tamper-evident frangible section has been broken.

Regardless of whether the user pushes down on the lid 48 or pulls up on the lid 48 in order to rupture the membrane, after the membrane has torn or otherwise ruptured, the lid 48 may be lifted, as shown in FIG. 13, by the thumb tab 64 to an open position to permit access to the container (omitted for ease of illustration in FIG. 13). In FIG. 13, the torn membrane 70' is shown around the inner peripheral edge of the closure base deck 47. A corresponding torn portion of the membrane on the lid skirt 60 is designated by the reference number 70". FIGS. 13–17 also show the torn membrane along the vertical edge of each triangular support member 72 and downwardly along the slanted back edge of each support member 72. For purposes of illustration, the figures show the torn material as a jagged line in an exaggerated scale. However, it will be appreciated that the torn material may actually have a less jagged edge or even a smooth edge.

With reference to FIGS. 4 and 13, the frangible, reduced-thickness section of material may be characterized as a membrane which has (1) a portion lying in a plane for a major part of the length of the connection between the lid 48 and closure base for 46, and (2) at least one portion that is generally straight and that is oriented at an oblique angle relative to the plane. The portion lying in a plane for a major part of the length of the connection between the lid 48 and the closure base 46 is the generally arcuate portion indicated by the reference number 70 in FIG. 4. The portion that is generally straight and that is oriented at an oblique angle relative to the plane is the portion designated by the reference number 70B in FIG. 4.

Figure 15:
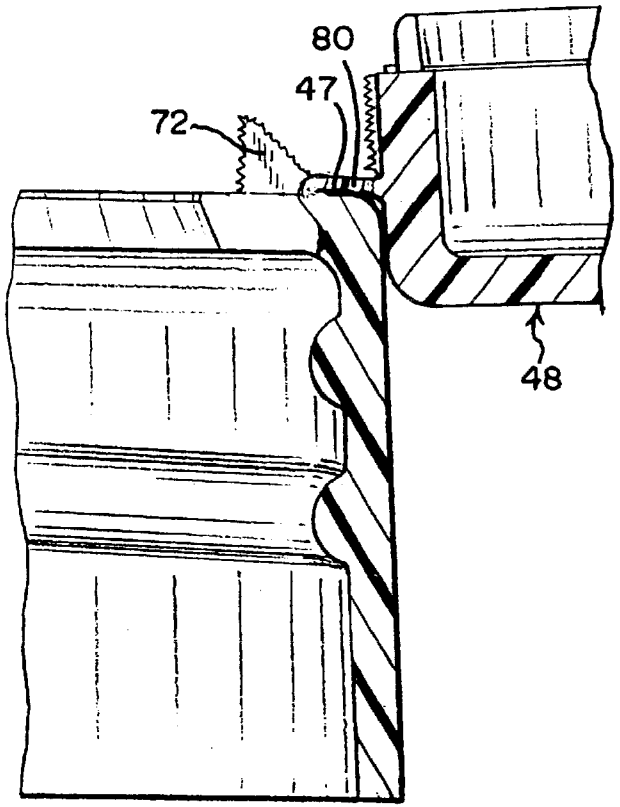
FIG. 15 is similar to FIG. 14, but FIG. 15 shows the lid in a fully opened orientation substantially 180° from the first closed position.
Figure 14:
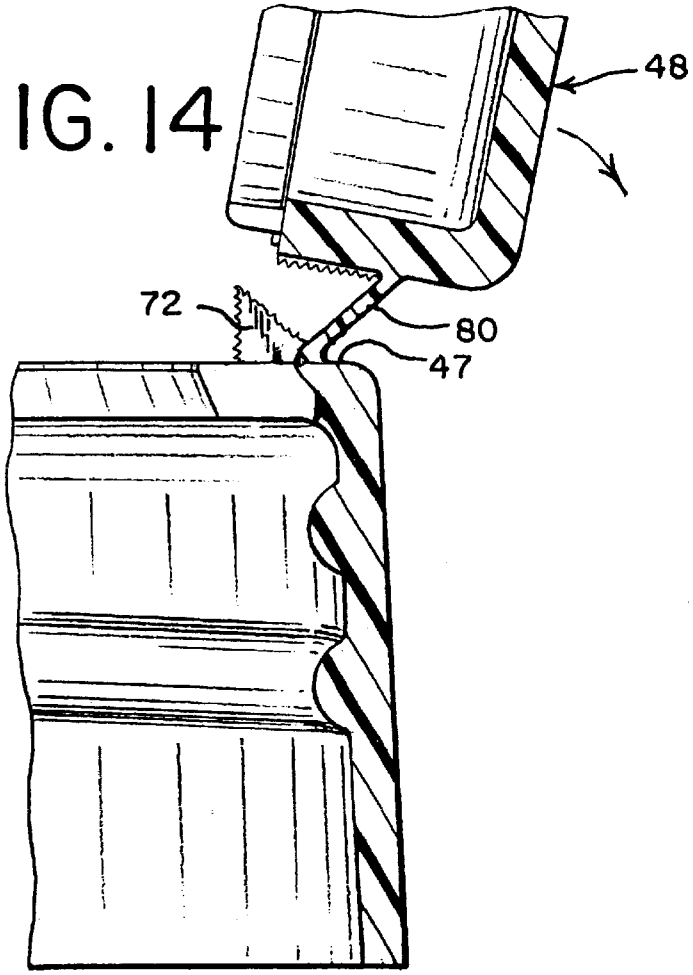
FIG. 14 is a fragmentary, cross-sectional view similar to FIG. 10, but in FIG. 14 the container is omitted for ease of illustration.

As illustrated in FIG. 14, the open lid 48 can be tilted rearwardly further, and as shown in FIG. 15, the lid 48 can be positioned to a full, or wide open, position wherein the hinge web 80 lies on the closure base deck 47 and wherein the lid 48 has a orientation which is generally 180° from the initial, as-molded, first closed position shown in FIG. 8. With the lid 48 in this position, there is substantially no interference with access to the interior of the container (not shown in FIG. 15), and a wide range of kitchen implements (i.e., knives, spoons, spatulas, tongs, etc.) can be readily used to remove product from the container.

The lid 48 can be readily re-closed by returning the lid 48 to the position illustrated in FIGS. 16 and 17. A slight downward force on the top of the lid 48 (in the direction of the arrow 83 as shown in FIG. 17) will seat the seal member 84 at the bottom of the lid in the container mouth 42. The engagement of the lid 48 within the container mouth 42, and the position of the hinge membrane 80 between the support members 72 prevent access to the container interior.

After the reduced-thickness section of material or membrane has been initially broken around the lid 48, it will be apparent to subsequent users that the initial, as-molded, closed condition of the structure has been breached (and that the lid 48 may possibly have been opened). The tamper indication function of the structure is effective to provide evidence of tampering without leaving separate waste pieces of loose material requiring disposal. Because the lid 48 always remains connected to the closure base 46 via the hinge web 80, there is no potential for misplacing or losing the lid 48.

Because the closure is preferably molded from a thermoplastic material in the first closed position illustrated in FIGS. 3 and 8, the mold cavity does not have to accommodate an open lid as is the case with other conventional types of closures wherein the lid is molded in an initially open configuration. Thus, because the lid is molded in a closed position in accordance with the present invention, the capacity of the mold is maximized, and the efficiency of manufacturing is increased.

It will be appreciated that an optional, inner seal structure (not illustrated) could be initially provided across the top of the container 41 or across the closure base opening. Such an inner seal could be a foil or thermoplastic membrane sealed to the top, annular surface of the container 41 or sealed to the annular underside of the closure base deck 47. Such an inner seal would have to be torn or cut away and removed after the lid 48 is lifted up to an open position.

It will be appreciated that the lid 48 and the container 41 could be initially molded together with the frangible membrane 70 and base 46 as a unitary extension of the top of the container 41 if the container is molded with an open bottom end. In such an alternate design, suitable means must be employed for subsequently filling the container 41 from an open bottom end of the container and subsequently closing the bottom of the container. To this end, the container 41 could be molded with the closure structure located at the top end and with the bottom end of the container open. The container could then be filled through the open bottom end, and then the bottom end of the container could be closed over by suitable means, such as molding the bottom of the container closed or by installing a separately formed bottom closure which could be threaded or snap-fit onto the container bottom. Alternatively, a separate closure could be secured to the container bottom with adhesive or thermal bonding techniques. With respect to such an alternate design, the alternative design may be characterized as a closure structure for a container wherein the closure structure comprises (1) the lid 48, (2) a lower closure portion or base 46 which is molded as a unitary part or extension of the container 41, (3) a hinge web connecting the lid and base, and (4) the frangible, reduced-thickness section of material initially connecting the lid, base, and hinge web. That is, the top of the container 41 may be regarded as including or defining the "base" or "lower closure portion" 46. Thus, the phrase "a closure structure for" as used in the claims appended hereto may be construed to include either a closure structure (or portion thereof) that is molded as a unitary part or extension of a container or a separate closure element adapted to be releasably or permanently mounted to the container.

It will be readily observed from the foregoing detailed description of the invention and from the illustrations thereof that numerous other variations and modifications may be effected without departing from the true spirit and scope of the novel concepts or principles of this invention.

What is claimed is:

1. A closure structure for a container that has an opening to the container interior, said closure comprising:

a closure base for extending around said container opening;

a lid on said closure base;

a hinge web having (1) a first end connected to said closure base, (2) a second end connected to said lid, and (3) two sides which each extends between said first and second ends; and a frangible, reduced-thickness section of material initially connecting said lid to said closure base and initially connecting both of said hinge web sides to one of said closure base and said lid for initially holding said lid sealed closed at a tamper-evident, first closed position and for subsequently accommodating movement of said lid relative to said first closed position to break said frangible connection and become selectively located at one of the following positions: (1) a second closed position inwardly of said first closed position, and (2) an open position outwardly of both said first closed position and second closed position.

2. The closure structure in accordance with claim 1 in which said closure structure is a separate closure that (1) is adapted to be mounted to said container, and (2) defines an access aperture for communicating with said container opening.

3. The closure structure in accordance with claim 1 in which said closure structure is formed as a unitary part of said container at said container opening.

4. The closure structure in accordance with claim 1 in which said structure is a separate closure that is adapted to be mounted to said container which has an inner peripheral surface around the container opening; and said lid includes a seal member for engaging at least a portion of said periphery of said inner peripheral surface when said lid is in said second closed position.

5. The closure structure in accordance with claim 1 in which said frangible, reduced-thickness section of material breaks when said lid is pushed inwardly with sufficient force.

6. The closure structure in accordance with claim 1 in which said frangible, reduced-thickness section of material breaks when said lid is pulled outwardly with sufficient force.

7. The closure structure in accordance with claim 1 in which said closure base includes a pair of outwardly projecting, spaced-apart support members; and said frangible, reduced-thickness section of material is a membrane which has (1) a portion lying in a plane for a major part of the length of the connection between said lid and said closure base, and (2) at least one portion that is generally straight and that is oriented at an oblique angle relative to said plane.

8. The closure structure in accordance with claim 1 in which said closure base includes an inner membrane seal for initially preventing communication through said closure base with the interior of the container until said inner membrane seal is breached.

9. The closure structure in accordance with claim 1 in which said web is generally rectangular.

10. The closure structure in accordance with claim 1 in which said closure base has an inner peripheral edge;

said lid includes a flange having an outer peripheral surface; and said frangible, reduced-thickness section of material connects said closure base inner peripheral edge to said lid flange outer peripheral surface.

11. The closure structure in accordance with claim 1 in which both of said hinge web sides are initially connected to said closure base.

* * * * *